US009957471B2

(12) United States Patent
Vaccaro et al.

(10) Patent No.: US 9,957,471 B2
(45) Date of Patent: May 1, 2018

(54) LIQUID LAUNDRY DETERGENT COMPOSITION COMPRISING A PARTICLE AND A GEL DISPERSED THEREIN

(71) Applicant: The Procter & Gamble Company, Cincinnati, OH (US)

(72) Inventors: Mauro Vaccaro, Newcastle Upon Tyne (GB); Anju Deepali Massey Brooker, Newcastle Upon Tyne (GB); Nigel Patrick Somerville-Roberts, Tyne & Wear (GB); Alan Thomas Brooker, Newcastle Upon Tyne (GB); Eric San Jose Robles, Newcastle Upon Tyne (GB); Melissa Cuthbertson, Newcastle Upon Tyne (GB); Lynn Donlon, Stockton-on-Tees (GB)

(73) Assignee: The Procter & Gamble Company, Cincinnati, OH (US)

( * ) Notice: Subject to any disclaimer, the term of this patent is extended or adjusted under 35 U.S.C. 154(b) by 45 days.

(21) Appl. No.: 15/352,944

(22) Filed: Nov. 16, 2016

(65) Prior Publication Data

US 2017/0137758 A1 May 18, 2017

(30) Foreign Application Priority Data

Nov. 16, 2015 (EP) ..... 15194753

(51) Int. Cl.

| | |
|---|---|
| ***C11D 1/22*** | (2006.01) |
| ***C11D 1/29*** | (2006.01) |
| ***C11D 3/43*** | (2006.01) |
| ***C11D 9/36*** | (2006.01) |
| ***C11D 17/00*** | (2006.01) |
| ***C11D 3/20*** | (2006.01) |
| ***C11D 3/37*** | (2006.01) |
| ***C11D 11/00*** | (2006.01) |
| ***C11D 17/04*** | (2006.01) |
| ***C11D 10/04*** | (2006.01) |
| ***C11D 3/18*** | (2006.01) |

(52) U.S. Cl.

CPC ..... *C11D 17/003* (2013.01); *C11D 1/22* (2013.01); *C11D 3/18* (2013.01); *C11D 3/202* (2013.01); *C11D 3/2013* (2013.01); *C11D 3/2065* (2013.01); *C11D 3/2079* (2013.01); *C11D 3/373* (2013.01); *C11D 10/04* (2013.01); *C11D 10/042* (2013.01); *C11D 11/0017* (2013.01); *C11D 17/0026* (2013.01); *C11D 17/0039* (2013.01); *C11D 17/043* (2013.01); *C11D 17/045* (2013.01)

(58) Field of Classification Search

CPC ..... C11D 1/22

See application file for complete search history.

(56) References Cited

U.S. PATENT DOCUMENTS

| | | | | |
|---|---|---|---|---|
| 7,135,451 | B2 | 11/2006 | Corona, III et al. | |
| 2005/0176610 | A1* | 8/2005 | Hsu | C11D 3/14 510/280 |
| 2005/0215457 | A1* | 9/2005 | Becks | C11D 1/83 510/438 |
| 2006/0276364 | A1* | 12/2006 | Kouvroukoglou | C11D 3/201 510/293 |
| 2014/0289969 | A1* | 10/2014 | Sadlowski | C11D 1/29 8/137 |
| 2015/0099684 | A1* | 4/2015 | Boutique | C11D 1/83 510/293 |
| 2016/0130528 | A1* | 5/2016 | Si | C11D 3/3773 510/347 |

FOREIGN PATENT DOCUMENTS

WO WO 02/057402 A1 7/2002

OTHER PUBLICATIONS

Jacob N Israelachvili et al., "Theory of Self-Assembly of Hydrocarbon Amphiphiles into Micelles and Bilayers", 1976, J. Chem. Society, Faraday Trans., 2, 72, 1525-1568.

European Search Report dated May 20, 2016, 7 pgs.

European Search Report dated May 3, 2016, 5 pgs.

U.S. Appl. No. 15/352,920, filed Nov. 16, 2016, Mauro Vaccaro et al.

* cited by examiner

*Primary Examiner* — Charles Boyer

(74) *Attorney, Agent, or Firm* — Melissa Krasovec; Leonard W. Lewis; Steven W. Miller

(57) ABSTRACT

Liquid laundry detergent compositions. Water-soluble unit dose articles that include a gel and a particle.

21 Claims, No Drawings

LIQUID LAUNDRY DETERGENT COMPOSITION COMPRISING A PARTICLE AND A GEL DISPERSED THEREIN

FIELD OF THE INVENTION

The present disclosure relates to liquid laundry detergent compositions and water-soluble unit dose articles comprising a gel and a particle.

BACKGROUND OF THE INVENTION

Certain cleaning actives come in the form or particles, or preferably are formulated in the form particles for reasons such as stability. However, it is difficult to formulate such particles in liquid laundry detergent compositions as there is a tendency for them to dissolve in the liquid composition, especially wherein the composition comprises water. Such dissolution could result in certain active materials reacting or degrading and so not being available for use in the wash.

Therefore, there is a need for a liquid laundry detergent composition comprising a particle comprising an active material, wherein the particle does not dissolve in the detergent composition but is released onto fabrics during the wash operation.

It was surprisingly found that the liquid laundry detergent composition of the present invention solved the above-mentioned technical problem. It was also surprisingly found that the composition of the present invention provided the added benefit of improving deposition of the particle onto fabrics during the wash operation.

SUMMARY OF THE INVENTION

The present disclosure relates to a liquid laundry detergent composition comprising a gel, where the gel comprises a lamellar phase composition, a particle comprising an active material and optionally a viscous hydrophobic ingredient, wherein the lamellar phase composition comprises a mixture of surfactant and a material selected from a fatty acid, a fatty alcohol or a mixture thereof, the mixture being in lamellar phase, wherein the viscous hydrophobic ingredient comprises silicone and/or petrolatum, and wherein the liquid laundry detergent composition comprises less than 20% by weight of the liquid laundry detergent composition of water.

The present disclosure also relates to a water-soluble unit dose article comprising a water-soluble film and at least a first internal compartment, wherein the first internal comprises a first liquid laundry detergent composition, wherein the first liquid laundry detergent composition is as according to the present invention, preferably wherein the first liquid laundry detergent composition comprises 100% by weight of the first liquid laundry detergent composition of the gel.

DETAILED DESCRIPTION OF THE INVENTION

Liquid Laundry Detergent Composition The present disclosure relates to a liquid laundry detergent composition comprising a gel and less than 20% by weight of the liquid laundry detergent composition of water.

The term 'liquid laundry detergent composition' refers to any laundry detergent composition comprising a liquid capable of wetting and treating fabric e.g., cleaning clothing in a domestic washing machine, and includes, but is not limited to, liquids, gels, pastes, dispersions and the like. The liquid composition can include solids or gases in suitably subdivided form, but the liquid composition excludes forms which are non-fluid overall, such as tablets or granules.

The liquid composition may be formulated into a unit dose article. The unit dose article of the present invention comprises a water-soluble film which fully encloses the liquid composition in at least one compartment. Suitable unit dose articles are described in more detail below.

The liquid laundry detergent composition can be used as a fully formulated consumer product, or may be added to one or more further ingredient to form a fully formulated consumer product. The liquid laundry detergent composition may be a 'pre-treat' composition which is added to a fabric, preferably a fabric stain, ahead of the fabric being added to a wash liquor.

The liquid laundry detergent composition can be used in a fabric hand wash operation or may be used in an automatic machine fabric wash operation.

The liquid laundry detergent composition may comprise between 10% and 100%, preferably between 15% and 80%, more preferably between 20% and 60% by weight of the liquid laundry detergent composition of the gel. The gel will be described in more detail below.

The liquid laundry detergent composition comprises less than 20%, preferably between 5% and 15% by weight of the liquid laundry detergent composition of water.

The liquid laundry detergent composition may comprise one or more detersive surfactants (separate to surfactant present in the gel). The detersive surfactant may be selected anionic surfactants, non-ionic surfactants or mixtures thereof. The anionic surfactant may be selected from linear alkybenzene sulphonate, alkoxylated alkyl sulphate, fatty acid or mixtures thereof.

Exemplary linear alkylbenzene sulphonates are $C_{10}$-$C_{16}$ alkyl benzene sulfonic acids, or $C_{11}$-$C_{14}$ alkyl benzene sulfonic acids. By 'linear', we herein mean the alkyl group is linear.

The alkoxylated alkyl sulphate anionic surfactant may be a $C_{10}$-$C_{18}$ alkyl ethoxy sulfate ($AE_xS$) wherein x is an average degree of ethoxylation of from 0.5 to 30, preferably between 1 and 10, more preferably between 1 and 5.

The term 'fatty acid' includes fatty acid or fatty acid salts. The fatty acids are preferably carboxylic acids which are often with a long unbranched aliphatic tail, which is either saturated or unsaturated. Suitable fatty acids include ethoxylated fatty acids. Suitable fatty acids or salts of the fatty acids for the present invention are preferably sodium salts, preferably C12-C18 saturated and/or unsaturated fatty acids more preferably C12-C14 saturated and/or unsaturated fatty acids and alkali or alkali earth metal carbonates preferably sodium carbonate.

Preferably the fatty acids are selected from the group consisting of lauric acid, myristic acid, palmitic acid, stearic acid, topped palm kernel fatty acid, coconut fatty acid and mixtures thereof.

Preferably, the non-ionic surfactant comprises a fatty alcohol alkoxylate, an oxo-synthesised fatty alcohol alkoxylate, Guerbet alcohol alkoxylates, alkyl phenol alcohol alkoxylates or a mixture thereof. The ethoxylated nonionic surfactant may be, e.g., primary and secondary alcohol ethoxylates, especially the $C_8$-$C_{20}$ aliphatic alcohols ethoxylated with an average of from 1 to 50 or even 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol.

The ethoxylated alcohol non-ionic surfactant can be, for example, a condensation product of from 3 to 8 mol of ethylene oxide with 1 mol of a primary alcohol having from 9 to 15 carbon atoms.

The non-ionic surfactant may comprise a fatty alcohol ethoxylate of formula $R(EO)_n$, wherein R represents an alkyl chain between 4 and 30 carbon atoms, (EO) represents one unit of ethylene oxide monomer and n has an average value between 0.5 and 20.

The liquid laundry detergent composition may comprise an adjunct ingredient. The adjunct ingredient may be selected from the group comprising bleach, bleach catalyst, dye, hueing dye, cleaning polymers including alkoxylated polyamines and polyethyleneimines, soil release polymer, surfactant, solvent, dye transfer inhibitors, encapsulated perfume, polycarboxylate polymers, non-aqueous solvents, structurants and mixtures thereof.

The Gel

The liquid laundry detergent composition of the present invention comprises a gel. Preferably, the gel is not present in a solid form, rather it is a viscous liquid form. The gel comprises a lamellar phase composition, a particle comprising an active material and optionally a viscous hydrophobic ingredient. The viscous hydrophobic ingredient comprises silicone and/or petrolatum.

A lamellar phase refers to packing of polar-headed long chain nonpolar-tail surfactant molecules (in the present case the surfactant and fatty acid and/or fatty alcohol of the gel) in an environment of bulk polar liquid, as sheets of bilayers separated by bulk liquid. The bilayers may have an open structure (i.e. sheets) or may for closed structures (i.e. vesicles). The formation of a lamellar phase can be predicted by the critical packing parameters of surfactant molecules. Preferably, the lamellar phase composition has a packing parameter in the range of from 0.5 to 1.0. The method for determining the packaging parameter is described in more detail below.

Preferably, the gel comprises between 50% and 90%, preferably between 60% and 80%, most preferably 65% by weight of the gel of the lamellar phase. The lamellar phase composition comprises surfactant and a material selected from a fatty acid, a fatty alcohol or a mixture thereof, wherein the mixture is in lamellar phase. Preferably the lamellar phase composition comprises a solvent. The solvent is preferably selected from water, glycerol, ethylene glycol, 1,3 propanediol, 1,2 propanediol, 2,3-butane diol, 1,3 butanediol, diethylene glycol, triethylene glycol, polyethylene glycol, glycerol formal dipropylene glycol, polypropylene glycol, dipropylene glycol n-butyl ether, ethanol and mixtures thereof, more preferably, the solvent is selected from water, glycerol, 1,2-propanediol, 1,3-propanediol, dipropylene glycol and mixtures thereof. Preferably, the lamellar phase comprises no more than 10% by weight of the lamellar phase of water. The lamellar phase may comprise between 0.5% and 10%, preferably between 1% and 7% by weight of the lamellar phase of water.

The solvent may comprise water and glycerol and wherein the ratio of water:glycerol is preferably between 1:5 and 5:1, more preferably 1:3 and 1:1, most preferably 1:2.

The solvent may comprise glycerol and dipropylene glycol and wherein the ratio of glycerol:dipropylene glycol is preferably between 1:10 and 1:30, more preferably 1:15 and 1:25, most preferably 1:20.

The solvent may comprise dipropylene glycol, water, 1,2-propanediol and glycerol and preferably wherein the ratio of dipropylene glycol:water:1,2-propanediol:glycerol is between 1.0:3.0:4.0:4.8 and 1:0.5:1.0:1.2, more preferably 1.0:2.0:3.0:3.8 and 1.0:1.5:2.0:2.2, most preferably 1.0:1.5:2.0:2.4.

Preferably, the molar ratio of surfactant to material selected from a fatty acid, a fatty alcohol or a mixture thereof present in the lamellar phase composition is in the range of from 1:1 to 2.5:1, more preferably 1:1 to 1.5:1.

Controlling such levels of solvent in this manner improves the compatibility of incorporating the lamellar phase composition in the detergent pouch.

Preferably, the lamellar phase comprises between 24% and 43%, preferably between 29% and 38%, more preferably 31% by weight of the lamellar phase of the surfactant. Preferably, the lamellar phase comprises between 12% and 23%, more preferably between 15% and 20%, most preferably 16% of the lamellar phase of a material selected from a fatty acid, a fatty alcohol or a mixture thereof.

Suitable surfactants include anionic surfactants, non-ionic surfactants, zwitterionic surfactants and amphoteric surfactants.

Suitable anionic surfactants include sulphate and sulphonate surfactants.

Suitable sulphonate surfactants include alkyl benzene sulphonate, such as $C_{10-13}$ alkyl benzene sulphonate. Suitable alkyl benzene sulphonate (LAS) is obtainable, or even obtained, by sulphonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. Another suitable anionic surfactant is alkyl benzene sulphonate that is obtained by DETAL catalyzed process, although other synthesis routes, such as HF, may also be suitable. A preferred surfactant is alkyl benzene sulphonate.

Suitable sulphate surfactants include alkyl sulphate, such as $C_{8-18}$ alkyl sulphate, or predominantly $C_{12}$ alkyl sulphate. The alkyl sulphate may be derived from natural sources, such as coco and/or tallow. Alternative, the alkyl sulphate may be derived from synthetic sources such as $C_{12-15}$ alkyl sulphate.

Another suitable sulphate surfactant is alkyl alkoxylated sulphate, such as alkyl ethoxylated sulphate, or a $C_{8-18}$ alkyl alkoxylated sulphate, or a $C_{8-18}$ alkyl ethoxylated sulphate. The alkyl alkoxylated sulphate may have an average degree of alkoxylation of from 0.5 to 20, or from 0.5 to 10. The alkyl alkoxylated sulphate may be a $C_{8-18}$ alkyl ethoxylated sulphate, typically having an average degree of ethoxylation of from 0.5 to 10, or from 0.5 to 7, or from 0.5 to 5 or from 0.5 to 3. The alkyl sulphate, alkyl alkoxylated sulphate and alkyl benzene sulphonates may be linear or branched, substituted or un-substituted.

Suitable anionic surfactant may be a mid-chain branched anionic surfactant, such as a mid-chain branched alkyl sulphate and/or a mid-chain branched alkyl benzene sulphonate. The mid-chain branches are typically $C_{1-4}$ alkyl groups, such as methyl and/or ethyl groups.

Another suitable anionic surfactant is alkyl ethoxy carboxylate.

The anionic surfactants are typically present in their salt form, typically being complexed with a suitable cation. Suitable counter-ions include alkanolamine cations, $Na^+$ and/or $K^+$.

The surfactant may be selected from alkyl benzene sulphonate, alkyl ethoxylated sulphate and mixtures thereof.

Suitable non-ionic surfactants are selected from the group consisting of: $C_8$-$C_{18}$ alkyl ethoxylates, such as, NEODOL® non-ionic surfactants from Shell; $C_6$-$C_{12}$ alkyl phenol alkoxylates wherein optionally the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols; $C_{14}$-$C_{22}$ mid-chain branched alkyl alkoxylates, typically having an average degree of alkoxylation of from 1 to 30; alkylpolysaccharides, such as alkylpolyglycosides; polyhydroxy fatty acid amides; ether capped poly(oxyalkylated) alcohol surfactants; and mixtures thereof. Suitable nonionic surfactants include secondary alcohol-based surfactants. Other suitable non-ionic d surfactants include EO/PO block co-polymer surfactants, such as the Plurafac® series of surfactants available from BASF, and sugar-derived surfactants such as alkyl N-methyl glucose amide.

Preferred surfactants include alkyl benzene sulphonate, alkyl ethoxylated sulphate, and mixtures thereof. Preferred surfactants include $C_{10}$-$C_{13}$ alkyl benzene sulphonate, $C_{12}$-$C_{15}$ alkyl ethoxylated sulphate having an average degree of ethoxylation in the range of from 1.0 to 5.0 and mixtures thereof. Preferably the surfactant is an anionic surfactant having a cationic counter-ion selected from sodium or calcium. Preferably, the surfactant has a HLB in the range of from 30 to 40.

Preferred fatty materials are selected from $C_8$-$C_{16}$ fatty acid, $C_8$-$C_{16}$ fatty alcohol and mixtures thereof. A highly preferred fatty material is $C_{12}$ fatty acid.

Preferably, the fatty material has a melting point of at least 40° C., more preferably at least 50° C. or even at least 60° C. Preferably, the fatty material is a fatty acid having a pKa in the range of from 6 to 8. Preferably, the fatty material has a HLB in the range of from 10 to 20.

The gel comprises a particle. The gel may comprise between 0.25% and 3%, more preferably between 0.5% and 2%, most preferably between 0.6% and 1.2% by weight of the gel of the particle. The particle is described in more detail below.

The gel may be present in the form of droplets dispersed within the liquid laundry detergent composition. By 'droplet' we herein mean where the gel is present in as a viscous liquid form present as one or more discrete droplets in the liquid detergent continuous phase. A droplet does not include forms in which the gel is solid.

The gel optionally comprises a viscous hydrophobic material. The viscous hydrophobic ingredient comprises silicone, petrolatum, methathesized unsaturated polyol esters, silane-modified oils or mixtures thereof.

When the viscous hydrophobic ingredient comprises polydimethylsiloxane then preferably the benefit delivery composition comprises at least 10 wt % polydimethylsiloxane.

When the viscous hydrophobic ingredient comprises polydimethylsiloxane then preferably the benefit delivery composition comprises a mixture of polydimethylsiloxane and perfume.

Suitable silicones are selected from the group consisting of cyclic silicones, polydimethylsiloxanes, aminosilicones, cationic silicones, silicone polyethers, silicone resins, silicone urethanes, and mixtures thereof.

A preferred silicone is a polydialkylsilicone, alternatively a polydimethyl silicone (polydimethyl siloxane or "PDMS"), or a derivative thereof. Preferably, the silicone has a viscosity at a temperature of 25° C. and a shear rate of 1000 $s^{-1}$ in the range of from 10 Pa s to 100 Pa s. Without wishing to be bound by theory, increasing the viscosity of the silicone improves the deposition of the perfume onto the treated surface. However, without wishing to be bound by theory, if the viscosity is too high, it is difficult to process and form the benefit delivery composition. A preferred silicone is AK 60000 from Wacker, Munich, Germany Other suitable silicones are selected from an aminofunctional silicone, amino-polyether silicone, alkyloxylated silicone, cationic silicone, ethoxylated silicone, propoxylated silicone, ethoxylated/propoxylated silicone, quaternary silicone, or combinations thereof. Suitable silicones are selected from random or blocky organosilicone polymers having the following formula:

$$[R_1R_2R_3SiO_{1/2}]_{(j+2)}[(R_4Si(X—Z)O_{2/2}]_k[R_4R_4SiO_{2/2}]_m[R_4SiO_{3/2}]_j$$

wherein:

- j is an integer from 0 to about 98; in one aspect j is an integer from 0 to about 48; in one aspect, j is 0;
- k is an integer from 0 to about 200, in one aspect k is an integer from 0 to about 50; when k=0, at least one of $R_1$, $R_2$ or $R_3$ is —X—Z;
- m is an integer from 4 to about 5,000; in one aspect m is an integer from about 10 to about 4,000; in another aspect m is an integer from about 50 to about 2,000;
- $R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy and X—Z;
- each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;
- each X in said alkyl siloxane polymer comprises a substituted or unsubstituted divalent alkylene radical comprising 2-12 carbon atoms, in one aspect each divalent alkylene radical is independently selected from the group consisting of $—(CH_2)_s—$ wherein s is an integer from about 2 to about 8, from about 2 to about 4; in one aspect, each X in said alkyl siloxane polymer comprises a substituted divalent alkylene radical selected from the group consisting of: $—CH_2—CH(OH)—CH_2—$; $—CH_2—CH_2—CH(OH)—$; and $$—CH_2—\overset{\overset{CH_3}{|}}{CH}—CH_2—;$$

each Z is selected independently from the group consisting of $$—\overset{\overset{Q}{|}}{N}—Q, \quad —\overset{\overset{Q}{|}}{\overset{+}{N}}—Q\,(A^{n-})_{1/n},$$

$$—\overset{\overset{Q}{|}}{N}—X—\overset{\overset{Q}{|}}{N}—Q, \quad —\overset{\overset{Q}{|}}{\overset{+}{N}}—X—\overset{\overset{Q}{|}}{\overset{+}{N}}—Q\,2(A^{n-})_{1/n},$$

$$—\overset{\overset{Q}{|}}{N}—X—\overset{\overset{Q}{|}}{\overset{+}{N}}—Q\,(A^{n-})_{1/n}, \quad —\overset{\overset{Q}{|}}{\overset{+}{N}}—X—\overset{\overset{Q}{|}}{N}—Q\,(A^{n-})_{1/n};$$

-continued

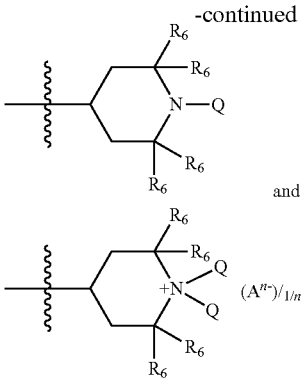

with the proviso that when Z is a quat, Q cannot be an amide, imine, or urea moiety and if Q is an amide, imine, or urea moiety, then any additional Q bonded to the same nitrogen as said amide, imine, or urea moiety must be H or a $C_1$-$C_6$ alkyl, in one aspect, said additional Q is H; for Z $A^{n-}$ is a suitable charge balancing anion. In one aspect $A^{n-}$ is selected from the group consisting of $Cl^-$, $Br^-$, $I^-$, methylsulfate, toluene sulfonate, carboxylate and phosphate; and at least one Q in said organosilicone is independently selected from —$CH_2$—CH(OH)—$CH_2$—$R_5$;

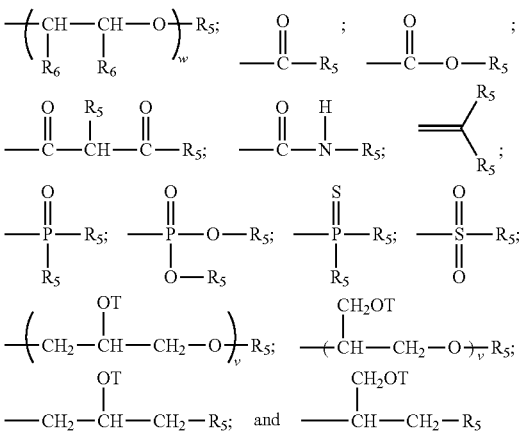

each additional Q in said organosilicone is independently selected from the group comprising of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —$CH_2$—CH(OH)—$CH_2$—$R_5$;

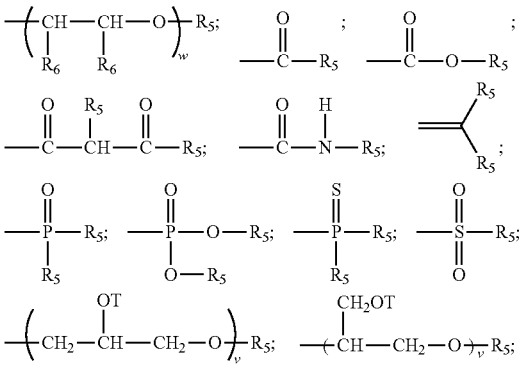

-continued

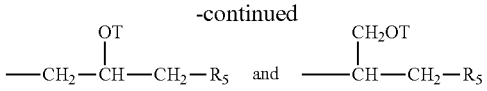

wherein each $R_5$ is independently selected from the group consisting of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —$(CHR_6$—$CHR_6$—O—$)_w$-L and a siloxyl residue;

each $R_6$ is independently selected from H, $C_1$-$C_{18}$ alkyl each L is independently selected from —C(O)—$R_7$ or $R_7$;

w is an integer from 0 to about 500, in one aspect w is an integer from about 1 to about 200;

in one aspect w is an integer from about 1 to about 50;

each $R_7$ is selected independently from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl; $C_6$-$C_{32}$ substituted alkylaryl and a siloxyl residue;

each T is independently selected from H, and

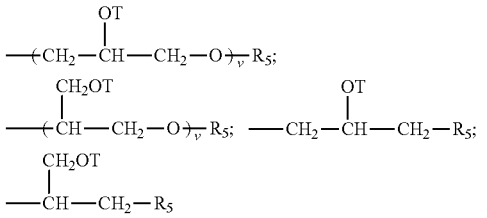

and wherein each v in said organosilicone is an integer from 1 to about 10, in one aspect, v is an integer from 1 to about 5 and the sum of all v indices in each Q in the said organosilicone is an integer from 1 to about 30 or from 1 to about 20 or even from 1 to about 10.

In another embodiment, the silicone may be chosen from a random or blocky organosilicone polymer having the following formula:

$$[R_1R_2R_3SiO_{1/2}]_{(j+2)}[(R_4Si(X—Z)O_{2/2}]_k[R_4R_4SiO_{2/2}]_m[R_4SiO_{3/2}]_j$$

wherein j is an integer from 0 to about 98; in one aspect j is an integer from 0 to about 48; in one aspect, j is 0;

k is an integer from 0 to about 200; when k=0, at least one of $R_1$, $R_2$ or $R_3$=—X—Z, in one aspect, k is an integer from 0 to about 50 m is an integer from 4 to about 5,000; in one aspect m is an integer from about 10 to about 4,000; in another aspect m is an integer from about 50 to about 2,000;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy and X—Z;

each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;

each X comprises of a substituted or unsubstituted divalent alkylene radical comprising 2-12 carbon atoms; in one aspect each X is independently selected from the group consisting of —$(CH_2)_s$—O—; —$CH_2$—CH(OH)—$CH_2$—O—;

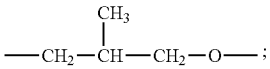

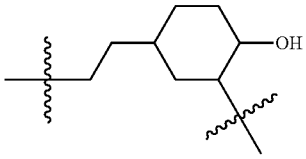

and

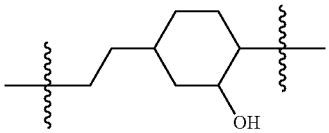

wherein each s independently is an integer from about 2 to about 8, in one aspect s is an integer from about 2 to about 4;

At least one Z in the said organosiloxane is selected from the grout) consisting of $R_5$;

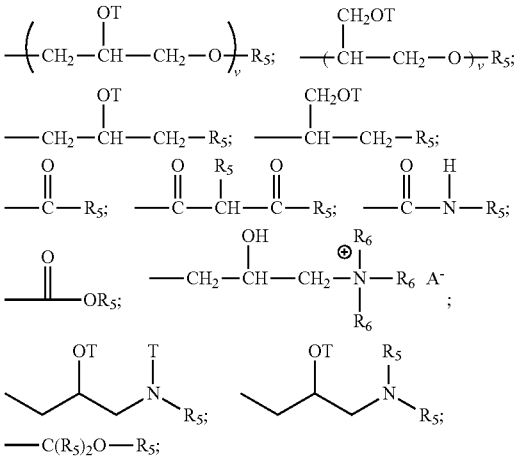

—$C(R_5)_2S$—$R_5$ and

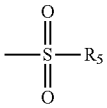

provided that when X is

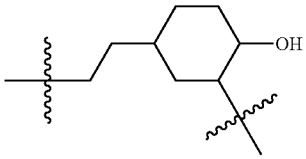

or

-continued

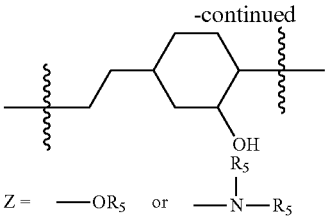

then wherein $A^-$ is a suitable charge balancing anion. In one aspect $A^-$ is selected from the group consisting of $Cl^-$, $Br^-$, $I^-$, methylsulfate, toluene sulfonate, carboxylate and phosphate and each additional Z in said organosilicone is independently selected from the group comprising of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $R_5$,

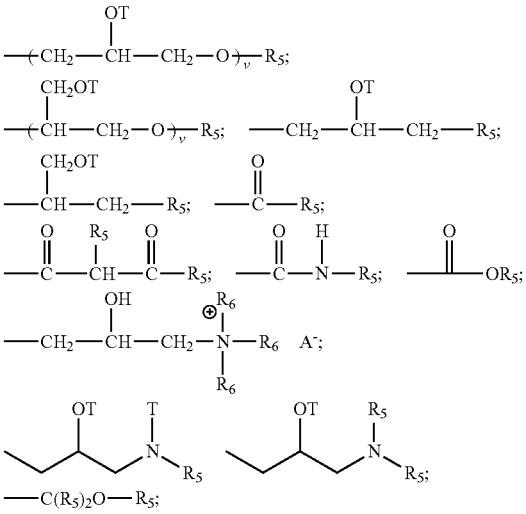

—$C(R_5)_2S$—$R_5$ and

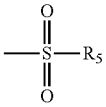

provided that when X is

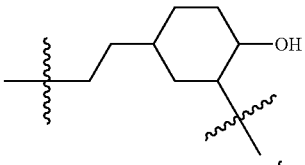

or

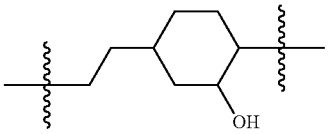

then

-continued $$Z = \text{—}OR_5 \quad \text{or} \quad \text{—}\overset{R_5}{\overset{|}{N}}\text{—}R_5$$

each $R_5$ is independently selected from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl or $C_6$-$C_{32}$ alkylaryl, or $C_6$-$C_{32}$ substituted alkylaryl, —$(CHR_6—CHR_6—O)_w$—$CHR_6$—$CHR_6$-L and siloxyl residue wherein each L is independently selected from —O—C(O)—$R_7$ or —O—$R_7$;

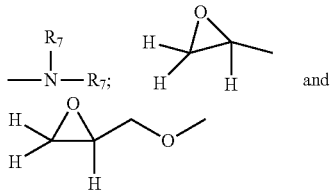

w is an integer from 0 to about 500, in one aspect w is an integer from 0 to about 200, one aspect w is an integer from 0 to about 50;

each $R_6$ is independently selected from H or $C_1$-$C_{18}$ alkyl;

each $R_7$ is independently selected from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted aryl, and a siloxyl residue;

each T is independently selected from H;

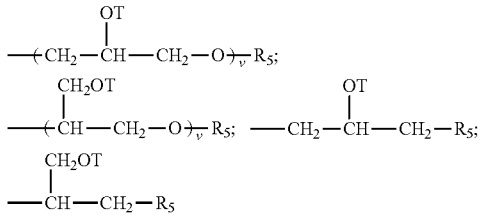

wherein each v in said organosilicone is an integer from 1 to about 10, in one aspect, v is an integer from 1 to about 5 and the sum of all v indices in each Z in the said organosilicone is an integer from 1 to about 30 or from 1 to about 20 or even from 1 to about 10.

A suitable silicone is a blocky cationic organopolysiloxane having the formula:

$$M_wD_xT_yQ_z$$

wherein:

M=[$SiR_1R_2R_3O_{1/2}$], [$SiR_1R_2G_1O_{1/2}$], [$SiR_1G_1G_2O_{1/2}$], [$SiG_1G_2G_3O_{1/2}$], or combinations thereof;

D=[$SiR_1R_2O_{2/2}$], [$SiR_1G_1O_{2/2}$], [$SiG_1G_2O_{2/2}$] or combinations thereof;

T=[$SiR_1O_{3/2}$], [$SiG_1O_{3/2}$] or combinations thereof;

Q=[$SiO_{4/2}$];

w=is an integer from 1 to (2+y+2z);

x=is an integer from 5 to 15,000;

y=is an integer from 0 to 98;

z=is an integer from 0 to 98;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy, $C_1$-$C_{32}$ alkylamino, and $C_1$-$C_{32}$ substituted alkylamino;

at least one of M, D, or T incorporates at least one moiety $G_1$, $G_2$ or $G_3$, and $G_1$, $G_2$, and $G_3$ are each independently selected from the formula:

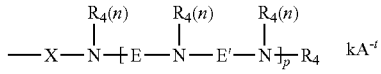

wherein:

X comprises a divalent radical selected from the group consisting of $C_1$-$C_{32}$ alkylene, $C_1$-$C_{32}$ substituted alkylene, $C_5$-$C_{32}$ or $C_6$-$C_{32}$ arylene, $C_5$-$C_{32}$ or $C_6$-$C_{32}$ substituted arylene, $C_6$-$C_{32}$ arylalkylene, $C_6$-$C_{32}$ substituted arylalkylene, $C_1$-$C_{32}$ alkoxy, $C_1$-$C_{32}$ substituted alkoxy, $C_1$-$C_{32}$ alkyleneamino, $C_1$-$C_{32}$ substituted alkyleneamino, ring-opened epoxide, and ring-opened glycidyl, with the proviso that if X does not comprise a repeating alkylene oxide moiety then X can further comprise a heteroatom selected from the group consisting of P, N and O;

each $R_4$ comprises identical or different monovalent radicals selected from the group consisting of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted alkylaryl;

E comprises a divalent radical selected from the group consisting of $C_1$-$C_{32}$ alkylene, $C_1$-$C_{32}$ substituted alkylene, $C_5$-$C_{32}$ or $C_6$-$C_{32}$ arylene, $C_5$-$C_{32}$ or $C_6$-$C_{32}$ substituted arylene, $C_6$-$C_{32}$ arylalkylene, $C_6$-$C_{32}$ substituted arylalkylene, $C_1$-$C_{32}$ alkoxy, $C_1$-$C_{32}$ substituted alkoxy, $C_1$-$C_{32}$ alkyleneamino, $C_1$-$C_{32}$ substituted alkyleneamino, ring-opened epoxide and ring-opened glycidyl, with the proviso that if E does not comprise a repeating alkylene oxide moiety then E can further comprise a heteroatom selected from the group consisting of P, N, and O;

E' comprises a divalent radical selected from the group consisting of $C_1$-$C_{32}$ alkylene, $C_1$-$C_{32}$ substituted alkylene, $C_5$-$C_{32}$ or $C_6$-$C_{32}$ arylene, $C_5$-$C_{32}$ or $C_6$-$C_{32}$ substituted arylene, $C_6$-$C_{32}$ arylalkylene, $C_6$-$C_{32}$ substituted arylalkylene, $C_1$-$C_{32}$ alkoxy, $C_1$-$C_{32}$ substituted alkoxy, $C_1$-$C_{32}$ alkyleneamino, $C_1$-$C_{32}$ substituted alkyleneamino, ring-opened epoxide and ring-opened glycidyl, with the proviso that if E' does not comprise a repeating alkylene oxide moiety then E' can further comprise a heteroatom selected from the group consisting of P, N, and O;

p is an integer independently selected from 1 to 50;

n is an integer independently selected from 1 or 2;

when at least one of $G_1$, $G_2$, or $G_3$ is positively charged, $A^{-t}$ is a suitable charge balancing anion or anions such that the total charge, k, of the charge-balancing anion or anions is equal to and opposite from the net charge on the moiety $G_1$, $G_2$ or $G_3$, wherein t is an integer independently selected from 1, 2, or 3; and $k \leq (p*2/t)+1$; such that the total number of cationic charges balances the total number of anionic charges in the organopolysiloxane molecule; and wherein at least one E does not comprise an ethylene moiety.

A metathesized unsaturated polyol ester refers to the product obtained when one or more unsaturated polyol ester ingredient(s) are subjected to a metathesis reaction. Metathesis is a catalytic reaction that involves the interchange of alkylidene units among compounds containing one or more double bonds (i.e., olefinic compounds) via the formation and cleavage of the carbon-carbon double bonds. Metathesis may occur between two of the same molecules (often referred to as self-metathesis) and/or it may occur between two different molecules (often referred to as cross-metathesis).

In general, suitable silane-modified oils comprise a hydrocarbon chain selected from the group consisting of saturated oil, unsaturated oil, and mixtures thereof; and a hydrolysable silyl group covalently bonded to the hydrocarbon chain.

The Particle

The gel comprises a particle, wherein the particle comprises an active material. The active material is described in more detail below.

The particle may be in the form of a core/shell capsule in which the active material is comprised within the core. Alternatively, the particle may be in the form of a carrier material wherein the active material is comprised within the carrier or on the carrier. Alternatively, the particle may be in the form of a mixture of a core/shell capsule in which the active material is comprised within the core and a carrier material wherein the active material is comprised within the carrier or on the carrier.

Wherein the particle is in the form of a core/shell particle, the shell may comprise polyvinyl alcohol, melamine formaldehyde, polylactide, polyglycolide, gelatin, polyacrylate, shellac, zein, chitosan, wax, hydrogenated vegetable oil, polysaccharides paraffin and mixtures thereof.

Wherein the particle is in the form of a carrier material, the carrier is preferably selected from the group comprising carbonate, sulphate, zeolite, talc, clay, saccharides, polysaccharides or mixtures thereof.

The carrier may form a matrix into which the active material is absorbed. Alternatively, the active material may be coated onto the carrier. Alternatively, the carrier may form a matrix into which the active material is absorbed and the active material is coated onto the carrier after which it absorbs into the matrix. For example, the active material may be coated onto the carrier and then at least part of the active material is absorbed into the carrier. The particle may be an agglomerate, an extrudate, a spray-dried particle, an aqueous slurry or a mixture thereof.

The particle may have a mean particle size of between 1 micron and 1000 microns, preferably between 10 microns to 750 microns, more preferably between 30 microns and 500 microns.

The particle may comprise between 2% and 100% by weight of the particle of the active material. The particle may comprise between 50% and 100% by weight of the particle of the active material. The particle may comprise between 20% and 70% by weight of the particle of the active material. The particle may comprise between 40% and 80% by weight of the particle of the active material.

The Active Material

The active material may be selected from chelants, cellulosic polymers, perfume microcapsules, enzymes, bleaches, hueing dyes, brighteners, metal oxides, clays or mixtures thereof.

The active material may be selected from chelants, cellulosic polymers, perfume microcapsules, enzymes or mixtures thereof.

Suitable chelants may be selected from: diethylene triamine pentaacetate, diethylene triamine penta(methyl phosphonic acid), ethylene diamine-N'N'-disuccinic acid, ethylene diamine tetraacetate, ethylene diamine tetra(methylene phosphonic acid), hydroxyethane di(methylene phosphonic acid), and any combination thereof. A suitable chelant is ethylene diamine-N'N'-disuccinic acid (EDDS) and/or hydroxyethane diphosphonic acid (HEDP). The laundry detergent composition may comprise ethylene diamine-N'N'-disuccinic acid or salt thereof. The ethylene diamine-N'N'-disuccinic acid may be in S,S enantiomeric form. The composition may comprise 4,5-dihydroxy-m-benzenedisulfonic acid disodium salt, glutamic acid-N,N-diacetic acid (GLDA) and/or salts thereof, 2-hydroxypyridine-1-oxide, Trilon P™ available from BASF, Ludwigshafen, Germany. Suitable chelants may also be calcium carbonate crystal growth inhibitors. Suitable calcium carbonate crystal growth inhibitors may be selected from the group consisting of: 1-hydroxyethanediphosphonic acid (HEDP) and salts thereof; N,N-dicarboxymethyl-2-aminopentane-1,5-dioic acid and salts thereof; 2-phosphonobutane-1,2,4-tricarboxylic acid and salts thereof; and any combination thereof.

The composition may comprise a calcium carbonate crystal growth inhibitor, such as one selected from the group consisting of: 1-hydroxyethanediphosphonic acid (HEDP) and salts thereof; N,N-dicarboxymethyl-2-aminopentane-1,5-dioic acid and salts thereof; 2-phosphonobutane-1,2,4-tricarboxylic acid and salts thereof; and any combination thereof. The chelant may be 1-hydroxyethanediphosphonic acid.

The cellulosic polymer may be selected from alkyl cellulose, alkyl alkoxyalkyl cellulose, carboxyalkyl cellulose, alkyl carboxyalkyl, and any combination thereof. The cellulosic polymer may be selected from carboxymethyl cellulose, methyl cellulose, methyl hydroxyethyl cellulose, methyl carboxymethyl cellulose, hydrophobically modified hydroxyethyl cellulose and mixtures thereof.

The cellulosic polymer may comprise a carboxymethyl cellulose. The carboxymethyl cellulose may have a degree of carboxymethyl substitution from 0.5 to 0.9 and a molecular weight from 100,000 Da to 300,000 Da.

The carboxymethyl cellulose may have a degree of substitution (DS) of from 0.01 to 0.99 and a degree of blockiness (DB) such that either DS+DB is of at least 1.00 or $DB+2DS-DS^2$ is at least 1.20. The substituted carboxymethyl cellulose can have a degree of substitution (DS) of at least 0.55. The carboxymethyl cellulose can have a degree of blockiness (DB) of at least 0.35. The substituted cellulosic polymer can have a DS+DB, of from 1.05 to 2.00.

The cellulosic polymer may comprise a hydrophobically modified carboxyethyl cellulose. The hydrophobically modified carboxyethyl cellulose may be derivatised with trimethyl ammonium substituted epoxide. The polymer may have a molecular weight of between 100,000 and 800,000 daltons.

The cationic cellulose polymers likewise include those which are commercially available and further include materials which can be prepared by conventional chemical modification of commercially available materials. Commercially available cellulose polymers of the Structural Formula I type include those with the INCI name Polyquaternium 10, such as those sold under the trade names: Ucare Polymer JR 30M, JR 400, JR 125, LR 400 and LK 400 polymers; Polyquaternium 67 such as those sold under the trade name Softcat SK™, all of which are marketed by Amerchol Corporation, Edgewater N.J.; and Polyquaternium 4 such as those sold under the trade name: Celquat H200 and Celquat L-200, available from National Starch and Chemical Company, Bridgewater, N.J. Other suitable polysaccharides include hydroxyethyl cellulose or hydoxypropylcellulose quaternized with glycidyl $C_{12}$-$C_{22}$ alkyl dimethyl ammonium chloride. Examples of such polysaccharides include the polymers with the INCI names Polyquaternium 24 such as those sold under the trade name Quaternium LM 200 by Amerchol Corporation, Edgewater N.J. Cationic starches described by D. B. Solarek in Modified Starches, Properties and Uses published by CRC Press (1986) and in U.S. Pat. No. 7,135,451, col. 2, line 33—col. 4, line 67.

Preferred encapsulated perfumes are perfume microcapsules, preferably of the core-and-shell architecture. Such perfume microcapsules comprise an outer shell defining an inner space in which the perfume is held until rupture of the perfume microcapsule during use of the fabrics by the consumer.

The microcapsule preferably comprises a core material and a wall material that at least partially surrounds said core, wherein said core comprises the perfume.

In one aspect, at least 75%, 85% or even 90% of said microcapsules may have a particle size of from about 1 microns to about 80 microns, about 5 microns to 60 microns, from about 10 microns to about 50 microns, or even from about 15 microns to about 40 microns. In another aspect, at least 75%, 85% or even 90% of said microcapsules may have a particle wall thickness of from about 60 nm to about 250 nm, from about 80 nm to about 180 nm, or even from about 100 nm to about 160 nm.

In one aspect, the microcapsule wall material may comprise: melamine, polyacrylamide, silicones, silica, polystyrene, polyurea, polyurethanes, polyacrylate based materials, polyacrylate esters based materials, gelatin, styrene malic anhydride, polyamides, aromatic alcohols, polyvinyl alcohol and mixtures thereof. In one aspect, said melamine wall material may comprise melamine crosslinked with formaldehyde, melamine-dimethoxyethanol crosslinked with formaldehyde, and mixtures thereof. In one aspect, said polystyrene wall material may comprise polyestyrene crosslinked with divinylbenzene. In one aspect, said polyurea wall material may comprise urea crosslinked with formaldehyde, urea crosslinked with gluteraldehyde, and mixtures thereof. In one aspect, said polyacrylate based wall materials may comprise polyacrylate formed from methylmethacrylate/dimethylaminomethyl methacrylate, polyacrylate formed from amine acrylate and/or methacrylate and strong acid, polyacrylate formed from carboxylic acid acrylate and/or methacrylate monomer and strong base, polyacrylate formed from an amine acrylate and/or methacrylate monomer and a carboxylic acid acrylate and/or carboxylic acid methacrylate monomer, and mixtures thereof.

In one aspect, said polyacrylate ester based wall materials may comprise polyacrylate esters formed by alkyl and/or glycidyl esters of acrylic acid and/or methacrylic acid, acrylic acid esters and/or methacrylic acid esters which carry hydroxyl and/or carboxy groups, and allylgluconamide, and mixtures thereof.

In one aspect, said aromatic alcohol based wall material may comprise aryloxyalkanols, arylalkanols and oligoalkanolarylethers. It may also comprise aromatic compounds with at least one free hydroxyl-group, especially preferred at least two free hydroxy groups that are directly aromatically coupled, wherein it is especially preferred if at least two free hydroxy-groups are coupled directly to an aromatic ring, and more especially preferred, positioned relative to each other in meta position. It is preferred that the aromatic alcohols are selected from phenols, cresoles (o-, m-, and p-cresol), naphthols (alpha and beta-naphthol) and thymol, as well as ethylphenols, propylphenols, fluorphenols and methoxyphenols.

In one aspect, said polyurea based wall material may comprise a polyisocyanate. In some embodiments, the polyisocyanate is an aromatic polyisocyanate containing a phenyl, a toluoyl, a xylyl, a naphthyl or a diphenyl moiety (e.g., a polyisocyanurate of toluene diisocyanate, a trimethylol propane-adduct of toluene diisocyanate or a trimethylol propane-adduct of xylylene diisocyanate), an aliphatic polyisocyanate (e.g., a trimer of hexamethylene diisocyanate, a trimer of isophorone diisocyanate and a biuret of hexamethylene diisocyanate), or a mixture thereof (e.g., a mixture of a biuret of hexamethylene diisocyanate and a trimethylol propane-adduct of xylylene diisocyanate). In still other embodiments, the polyisocyanate may be crosslinked, the cross-linking agent being a polyamine (e.g., diethylenetriamine, bis(3-aminopropyl)amine, bis(hexaethylene)triamine, tris(2-aminoethyl)amine, triethylenetetramine, N,N'-bis(3-aminopropyl)-1,3-propanediamine, tetraethylenepentamine, pentaethylenehexamine, branched polyethylenimine, chitosan, nisin, gelatin, 1,3-diaminoguanidine monohydrochloride, 1,1-dimethylbiguanide hydrochloride, or guanidine carbonate).

In one aspect, said polyvinyl alcohol based wall material may comprise a crosslinked, hydrophobically modified polyvinyl alcohol, which comprises a crosslinking agent comprising i) a first dextran aldehyde having a molecular weight of from 2,000 to 50,000 Da; and ii) a second dextran aldehyde having a molecular weight of from greater than 50,000 to 2,000,000 Da.

The perfume material of the perfume encapsulate can be any suitable perfume. Those skilled in the art will be aware of suitable perfume materials.

The enzyme may be selected from the group comprising hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination is a cocktail of conventional applicable enzymes like protease, lipase, cutinase and/or cellulase in conjunction with amylase.

Water-Soluble Unit Dose Article

A further aspect of the present invention is a water-soluble unit dose article comprising a water-soluble film and at least a first internal compartment, wherein the first internal comprises a first liquid laundry detergent composition, wherein the first liquid laundry detergent composition is as according to the present invention, preferably wherein the first liquid laundry detergent composition comprises 100% by weight of the liquid laundry detergent composition of the gel.

In such an embodiment, the water-soluble unit dose article comprises at least one water-soluble film shaped such that the unit-dose article comprises at least one internal compartment surrounded by the water-soluble film. The at least one compartment comprises the liquid laundry detergent composition. The water-soluble film is sealed such that the liquid laundry detergent composition does not leak out of the compartment during storage. However, upon addition of the water-soluble unit dose article to water, the water-soluble film dissolves and releases the contents of the internal compartment into the wash liquor.

The compartment should be understood as meaning a closed internal space within the unit dose article, which holds the composition. Preferably, the unit dose article comprises a water-soluble film. The unit dose article is manufactured such that the water-soluble film completely surrounds the composition and in doing so defines the compartment in which the composition resides. The unit dose article may comprise two films. A first film may be shaped to comprise an open compartment into which the composition is added. A second film is then laid over the first film in such an orientation as to close the opening of the compartment. The first and second films are then sealed together along a seal region. The film is described in more detail below.

The unit dose article may comprise more than one compartment, even at least two compartments, or even at least three compartments. The compartments may be arranged in superposed orientation, i.e. one positioned on top of the other. Alternatively, the compartments may be positioned in a side-by-side orientation, i.e. one orientated next to the other. The compartments may even be orientated in a 'tyre and rim' arrangement, i.e. a first compartment is positioned next to a second compartment, but the first compartment at least partially surrounds the second compartment, but does not completely enclose the second compartment. Alternatively one compartment may be completely enclosed within another compartment.

Wherein the unit dose article comprises at least two compartments, one of the compartments may be smaller than the other compartment. Wherein the unit dose article comprises at least three compartments, two of the compartments may be smaller than the third compartment, and preferably the smaller compartments are superposed on the larger compartment. The superposed compartments preferably are orientated side-by-side.

In a multi-compartment orientation, the composition according to the present invention may be comprised in at least one of the compartments. It may for example be comprised in just one compartment, or may be comprised in two compartments, or even in three compartments.

The film of the present invention is soluble or dispersible in water. The water-soluble film preferably has a thickness of from 20 to 150 micron, preferably 35 to 125 micron, even more preferably 50 to 110 micron, most preferably about 76 micron.

Preferably, the film has a water-solubility of at least 50%, preferably at least 75% or even at least 95%, as measured by the method set out here after using a glass-filter with a maximum pore size of 20 microns:

5 grams±0.1 gram of film material is added in a pre-weighed 3 L beaker and 2 L±5 ml of distilled water is added. This is stirred vigorously on a magnetic stirrer, Labline model No. 1250 or equivalent and 5 cm magnetic stirrer, set at 600 rpm, for 30 minutes at 30° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers which are from about 60% to about 98% hydrolysed, preferably about 80% to about 90% hydrolysed, to improve the dissolution characteristics of the material.

Preferred films exhibit good dissolution in cold water, meaning unheated distilled water. Preferably such films exhibit good dissolution at temperatures of 24° C., even more preferably at 10° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol under the trade references M8630, M8900, M8779, M8310.

Of the total PVA resin content in the film described herein, the PVA resin can comprise about 30 to about 85 wt % of the first PVA polymer, or about 45 to about 55 wt % of the first PVA polymer. For example, the PVA resin can contain about 50 w. % of each PVA polymer, wherein the viscosity of the first PVA polymer is about 13 cP and the viscosity of the second PVA polymer is about 23 cP.

Naturally, different film material and/or films of different thickness may be employed in making the compartments of the present invention. A benefit in selecting different films is that the resulting compartments may exhibit different solubility or release characteristics.

The film material herein can also comprise one or more additive ingredients. For example, it can be beneficial to add plasticisers, for example glycerol, ethylene glycol, diethyleneglycol, propylene glycol, sorbitol and mixtures thereof. Other additives may include water and functional detergent additives, including surfactant, to be delivered to the wash water, for example organic polymeric dispersants, etc.

The film may be opaque, transparent or translucent. The film may comprise a printed area. The printed area may cover between 10 and 80% of the surface of the film; or between 10 and 80% of the surface of the film that is in contact with the internal space of the compartment; or between 10 and 80% of the surface of the film and between 10 and 80% of the surface of the compartment.

The area of print may cover an uninterrupted portion of the film or it may cover parts thereof, i.e. comprise smaller areas of print, the sum of which represents between 10 and 80% of the surface of the film or the surface of the film in contact with the internal space of the compartment or both.

The area of print may comprise inks, pigments, dyes, blueing agents or mixtures thereof. The area of print may be opaque, translucent or transparent.

The area of print may comprise a single colour or maybe comprise multiple colours, even three colours. The area of print may comprise white, black, blue, red colours, or a mixture thereof. The print may be present as a layer on the surface of the film or may at least partially penetrate into the film. The film will comprise a first side and a second side. The area of print may be present on either side of the film, or be present on both sides of the film. Alternatively, the area of print may be at least partially comprised within the film itself.

The area of print may comprise an ink, wherein the ink comprises a pigment. The ink for printing onto the film has preferably a desired dispersion grade in water. The ink may be of any color including white, red, and black. The ink may be a water-based ink comprising from 10% to 80% or from 20% to 60% or from 25% to 45% per weight of water. The ink may comprise from 20% to 90% or from 40% to 80% or from 50% to 75% per weight of solid.

The ink may have a viscosity measured at 20° C. with a shear rate of 1000 $s^{-1}$ between 1 and 600 cPs or between 50 and 350 cPs or between 100 and 300 cPs or between 150 and 250 cPs. The measurement may be obtained with a cone-plate geometry on a TA instruments AR-550 Rheometer.

The area of print may be achieved using standard techniques, such as flexographic printing or inkjet printing. Preferably, the area of print is achieved via flexographic printing, in which a film is printed, then moulded into the shape of an open compartment. This compartment is then filled with a detergent composition and a second film placed over the compartment and sealed to the first film. The area of print may be on either or both sides of the film.

Alternatively, an ink or pigment may be added during the manufacture of the film such that all or at least part of the film is coloured.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

The water-soluble unit dose article may comprise a second internal compartment, wherein the second compartment comprises a second composition, wherein the second composition comprises less than 5% by weight of the second composition of the gel, more preferably the second composition is substantial free of the gel. The second composition may be a liquid. The second liquid laundry detergent composition may comprise between 10% and 50% by weight of the second liquid laundry detergent composition of an anionic surfactant, a non-ionic surfactant or a mixture thereof.

Process of Making

The liquid laundry detergent composition may be made via the following steps:

(a) contacting a surfactant and a material selected from a fatty acid, a fatty alcohol or a mixture thereof to form a lamellar phase composition;

(b) optionally contacting the lamellar phase composition with viscous hydrophobic ingredient, preferably silicone, (c) contacting the lamellar phase composition with the particulate benefit agent to form the gel;

(d) forming the liquid laundry detergent composition by optionally adding the gel to other ingredients;

(e) optionally enclosing the benefit delivery composition with a water-soluble film to form a unit dose article, wherein the material selected from a fatty acid, a fatty alcohol or a mixture thereof has a melting point of at least 40° C., wherein in step (a) the material selected from a fatty acid, a fatty alcohol or a mixture thereof is at a temperature above its melting point when it is contacted with the surfactant, and wherein the material selected from a fatty acid, a fatty alcohol or a mixture thereof is subsequently cooled to a temperature below its melting point.

Step (a). Forming a lamellar phase composition: During step (a), a surfactant is contacted to a material selected from a fatty acid, a fatty alcohol or a mixture thereof, to form a lamellar phase composition. During step (a), the material selected from a fatty acid, a fatty alcohol or a mixture thereof is at a temperature above its melting point when it is contacted with the surfactant. Preferably, the surfactant is at a temperature above the melting point of the material selected from a fatty acid, a fatty alcohol or a mixture thereof when it is contacted with the material selected from a fatty acid, a fatty alcohol or a mixture thereof. If present, preferably the water is at a temperature above the melting point of the material selected from a fatty acid, a fatty alcohol or a mixture thereof when it is contacted to the material selected from a fatty acid, a fatty alcohol or a mixture thereof.

The surfactant and material selected from a fatty acid, a fatty alcohol or a mixture thereof may be contacted at a temperature of at least 40° C., or even at least 70° C. Preferred heating means include hot water jacketing and/or hot oil jacketing. Other heating means include direct heat, electrical tracing, steam heating.

Suitable equipment for contacting the surfactant to the material selected from a fatty acid, a fatty alcohol or a mixture thereof include mixers such as DPM range of high torque mixers from Charles Ross & Son Company, Hauppauge, N.Y.

Preferably, step (a) is carried out at a pH in the range of from 4.0 to 7.0, more preferably from 5.0 to 6.0. When the fatty material is a fatty acid, preferably step (a) is carried out at a pH that corresponds to, or is similar to, the pKa of the fatty acid. When the fatty material is a fatty acid, preferably step (a) is carried out at a pH no greater than 0.5 pH units above the pKa of the fatty acid, and no less than 0.5 pH units below the pKa of the fatty acid.

Step (b). Contacting lamellar phase with hydrophobic ingredient: During step (b), the lamellar phase composition is optionally contacted to viscous hydrophobic material, preferably silicone, to form the benefit delivery composition. Preferably, the step (b) is carried out under conditions of low shear, typically having a maximum tip speed of 2.5 $ms^{-1}$, preferably 2.0 $ms^{-1}$, or even 1.5 $ms^{-1}$. Preferably, step (b) is carried out at a maximum shear rate of 500 $s^{-1}$, or from 400 $s^{-1}$ or even 300 $s^{-1}$.

Step (c). Contacting the lamellar phase composition with the particulate benefit agent: During step (c), the lamellar phase composition is contacting with the particulate benefit agent to form the gel. Preferably, the step (c) is carried out under conditions of low shear, typically having a maximum tip speed of 2.5 $ms^{-1}$, preferably 2.0 $ms^{-1}$, or even 1.5 $ms^{-1}$.

Preferably, step (c) is carried out at a maximum shear rate of 500 $s^{-1}$, or from 400 $s^{-1}$ or even 300 $s^{-1}$.

Step (d). Adding the gel to other ingredients to form the liquid laundry detergent composition: During step (d), the gel is optionally added to other ingredients to form the liquid laundry detergent composition. Other ingredients include normal ingredients used in laundry detergent compositions and will be known to the skilled person. Preferably, the step (d) is carried out under conditions of low shear, typically having a maximum tip speed of 2.5 $ms^{-1}$, preferably 2.0 $ms^{-1}$, or even 1.5 $ms^{-1}$. Preferably, step (d) is carried out at a maximum shear rate of 500 $s^{-1}$, or from 400 $s^{-1}$ or even 300 $s^{-1}$.

Step (e). Forming a unit dose article: During step (e), the benefit delivery composition is enclosed by a water-soluble film to form a unit dose article.

The process of forming the pouch may be continuous or intermittent. The process typically comprises the general steps of forming an open pouch, preferably by forming a water-soluble film into a mould to form said open pouch, filling the open pouch with a composition, closing the open pouch filled with a composition, preferably using a second water-soluble film to form the detergent pouch. The second film may also comprise compartments, which may or may not comprise compositions. Alternatively, the second film may be a second closed pouch containing one or more compartments, used to close the open pouch. Preferably, the process is one in which a web of detergent pouch are made, said web is then cut to form individual detergent pouchs.

The detergent pouch may be made by thermoforming, vacuum-forming or a combination thereof. Detergent pouches may be sealed using any sealing method known in the art. Suitable sealing methods may include heat sealing, solvent sealing, pressure sealing, ultrasonic sealing, pressure sealing, laser sealing or a combination thereof.

The detergent pouches may be dusted with a dusting agent. Dusting agents can include talc, silica, zeolite, carbonate or mixtures thereof.

An exemplary means of making the detergent pouch of the present invention is a continuous process for making an article according to any preceding claims, comprising the steps of:

a. continuously feeding a first water-soluble film onto a horizontal portion of an continuously and rotatably moving endless surface, which comprises a plurality of moulds, or onto a non-horizontal portion thereof and continuously moving the film to said horizontal portion;
b. forming from the film on the horizontal portion of the continuously moving surface, and in the moulds on the surface, a continuously moving, horizontally positioned web of open pouches;
c. filling the continuously moving, horizontally positioned web of open pouches with a product, to obtain a horizontally positioned web of open, filled pouches;
d. preferably continuously, closing the web of open pouches, to obtain closed pouches, preferably by feeding a second water-soluble film onto the horizontally positioned web of open, filed pouches, to obtain closed pouches; and
e. optionally sealing the closed pouches to obtain a web of closed pouches.

Packing Parameter: The surfactant Packing Parameter (N), is calculated from various molecular descriptors of the surfactant molecule's chemical structure, as described in more detail below. The surfactant Packing Parameter (N) is defined as:

$$N=v/1\ a_0$$

wherein, v is the volume of the hydrocarbon core in cubic nanometers, l is the length of the hydrocarbon chains, and $a_0$ is the area of the surfactant head-group at the interface of the hydrophobic core.

The volume of the hydrocarbon core of a saturated chain (v), in cubic nanometers, is determined according to the following equation:

$$v=0.027(n_c+n_{Me})$$

wherein, $n_c$ is the total number of carbon atoms per chain, and $n_{Me}$ is the number of methyl groups which are twice the size of a $CH_2$ group.

The maximum length of a fully extended hydrocarbon chain (1) (in nanometers) is calculated according to the following equation:

$$1=0.15+0.127\ n_c$$

wherein, $n_c$ is the total number of carbon atoms per chain.

The 0.15 nm in this equation comes from van der Waals radius of the terminal methyl group (0.21 nm) minus half the bond length of the first atom not contained in the hydrocarbon core (0.06 nm). The 0.127 nm is the carbon-carbon bond length (0.154 nm) projected onto the direction of the chain in the all-trans configuration.

The area of the surfactant head-group at the interface of the hydrophobic core ($a_0$), is determined according to the calculations described in the following published article: "Theory of Self-Assembly of Hydrocarbon Amphiphiles into Micelles and Bilayers" 1976, J. Chem. Soc., Faraday Trans. 2, 72, 1525-1568, Jacob N. Israelachvili, D. John Mitchell and Barry W. Ninham Method for measuring viscosity: The viscosity is measured by the following method, which generally represents the zero-shear viscosity (or zero-rate viscosity). Viscosity measurements are made with an AR2000 Controlled-Stress Rheometer (TA Instruments, New Castle, Del., U.S.A.), and accompanying software version 5.7.0. The instrument is outfitted with a 40 mm stainless steel parallel plate (TA Instruments catalog no. 511400.901) and Peltier plate (TA Instruments catalog no. 533230.901). The calibration is done in accordance with manufacturer recommendations. A refrigerated, circulating water bath set to 25° C. is attached to the Peltier plate.

Measurements are made on the instrument with the following procedures: Conditioning Step (pre-condition the sample) under "Settings" label, initial temperature: 25° C., pre-shear at 5.0 $s^{-1}$ for 1 minute, equilibrate for 2 minutes; Flow-Step (measure viscosity) under "Test" Label, Test Type: "Steady State Flow", Ramp: "shear rate 1/s" from 0.001 $s^{-1}$ and 1000 $s^{-1}$, Mode: "Log", Points per Decade: 15, Temperate: 25° C., Percentage Tolerance: 5, Consecutive with Tolerance: 3, Maximum Point Time: 45 sec, Gap set to 1000 micrometers, Stress-Sweep Step is not checked; Post-Experiment Step under "Settings" label; Set temperature: 25° C.

More than 1.25 ml of the test sample of the component to be measured is dispensed through a pipette on to the center of the Peltier plate. The 40 mm plate is slowly lowered to 1100 micrometers, and the excess sample is trimmed away from the edge of the plate with a rubber policeman trimming tool or equivalent. Lower the plate to 1000 micrometers (gap setting) prior to collecting the data.

Discard any data points collected with an applied rotor torque of less than 1 micro-N'm (e.g. discard data less than ten-fold the minimum torque specification). Create a plot of viscosity versus shear rate on a log-log scale. These plotted data points are analyzed in one of three ways to determine the viscosity value:

first, if the plot indicates that the sample is Newtonian, in that all viscosity values fall on a plateau within +/−20% of the viscosity value measured closest to 1 micro-N·m, then the viscosity is determined by fitting the 'Newtonian' fit model in the software to all the remaining data;

second, if the plot reveals a plateau in which the viscosity does not change by +/−20% at low shear rates and a sharp, nearly-linear decrease in viscosity in excess of the +/−20% at higher shear rates, then the viscosity is determined by applying the "Best Fit Using Viscosity vs. Rate" option from the "Analysis Toolbar";

third, if the plot indicates that the sample is only shear-thinning, in that there is only a sharp, nearly-linear decrease in viscosity, then the material is characterized by a viscosity which is taken as the largest viscosity in the plotted data, generally a viscosity measured close to 1 micro-N·m of applied torque.

Report the average value of the replicates as the viscosity of the component, in units of Pa·s.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

EXAMPLES

The stability of two different solid particles comprising an active formulated into gels of the present invention (suitable for inclusion in the liquid laundry detergent composition of the present invention) were monitored. The number of particles per surface area of gel were monitored over time by using an optical microscope Nikon Eclipse ME-600 with polarized light. The following gels comprising lamellar phases were prepared (Table 1). Gels land 2 are according to the present invention. 1-hydroxyethanediphosphonic acid (HEDP) was added as the solid active. The HEDP was present as a 60% active particle.

TABLE 1

| Wt % | Gel 1 | Gel 2 |
|---|---|---|
| Deionised water | 3.53 | 3.53 |
| Glycerol | 5.68 | 5.68 |

TABLE 1-continued

| Wt % | Gel 1 | Gel 2 |
|---|---|---|
| 1,2-propanediol | 4.73 | 4.73 |
| Dipropylene glycol | 2.36 | 2.36 |
| Linear alkylbenzene sulphonate | 28.46 | 28.46 |
| Dodecanoic Acid | 15.02 | 15.02 |
| Polydimethylsiloxane 60000 Da | 32.22 | 32.22 |
| 1-hydroxyethanediphosphonic acid (HEDP) | 8.00 | 0 |
| Perfume Microcapsules | 0 | 8.0 |
| Total | 100 | 100 |

A 0.1 gram portion of each gel was placed on a glass slide by smearing a thin application of the gel and applied a coverslip to view under the microscope. The area to be imaged was identified by marking on the coverslip to identify the same area a week later. The results can be seen in Table 2.

TABLE 2

| sample | Number of particles/mm^2 (time 0) | Number of particles/mm^2 (time 1 week) |
|---|---|---|
| Gel 1 | 18.4 | 18.4 |
| Gel 2 | 8.8 | 8.8 |

All the gel formulations based on the present invention have showed to be able to retain solid particles during storage.

What is claimed is:

1. A liquid laundry detergent composition comprising:

a gel, wherein the gel comprises:

a) lamellar phase composition;

b) a particle comprising an active material; and c) optionally a viscous hydrophobic ingredient, wherein 1) the lamellar phase composition comprises a mixture comprising one or more surfactants and a material selected from a fatty acid, a fatty alcohol, or a mixture thereof, wherein the mixture is in lamellar phase, 2) the viscous hydrophobic ingredient, if present, comprises silicone and/or petrolatum, and 3) the liquid laundry detergent composition comprises less than about 20%, by weight of the liquid laundry detergent composition, of water.

2. A liquid laundry detergent composition according to claim 1, wherein the liquid laundry detergent composition comprises between about 10% and about 100%, by weight of the liquid laundry detergent composition, of the gel.

3. A liquid laundry detergent composition according to claim 2, wherein the liquid laundry detergent composition comprises between about 15% and about 80%, by weight of the liquid laundry detergent composition, of the gel.

4. A liquid laundry detergent composition according to claim 3, wherein the liquid laundry detergent composition comprises between about 20% and about 60%, by weight of the liquid laundry detergent composition, of the gel.

5. A liquid laundry detergent composition according to claim 1, wherein the gel comprises between about 50% and about 90%, by weight of the gel, of the lamellar phase composition.

6. A liquid laundry detergent composition according to claim 5, wherein the gel comprises between about 60% and about 80%, by weight of the gel, of the lamellar phase composition.

7. A liquid laundry detergent composition according to claim 6, wherein the gel comprises about 65%, by weight of the gel, of the lamellar phase composition.

8. A liquid laundry detergent composition according to claim 1, wherein the lamellar phase composition comprises between about 24% and about 43%, by weight of the lamellar phase composition, of the surfactant.

9. A liquid laundry detergent composition according to claim 8, wherein the lamellar phase composition comprises between about 29% and about 38%, by weight of the lamellar phase composition, of the surfactant.

10. A liquid laundry detergent composition according to claim 1, wherein the surfactant is selected from the group consisting of alkyl benzene sulphonate, alkyl ethoxylated sulphate, and mixtures thereof.

11. A liquid laundry detergent composition according to claim 1, wherein the lamellar phase composition comprises between about 12% and about 23%, by weight of the lamellar phase composition, of the material selected from a fatty acid, a fatty alcohol, or a mixture thereof.

12. A liquid laundry detergent composition according to claim 11, wherein the lamellar phase composition comprises between about 15% and about 20%, by weight of the lamellar phase composition, of the material selected from a fatty acid, a fatty alcohol, or a mixture thereof.

13. A liquid laundry detergent composition according to claim 1, wherein the gel comprises between about 0.25% and about 3%, by weight of the gel, of the particle.

14. A liquid laundry detergent composition according to claim 13, wherein the gel comprises between about 0.5% and about 2%, by weight of the gel, of the particle.

15. A liquid laundry detergent composition according to claim 1, wherein the particle is in a form of a core/shell capsule in which the active material is comprised within a core of the core/shell capsule, wherein the active material is comprised within a carrier material or on the carrier material, or a mixture thereof.

16. A liquid laundry detergent composition according to claim 1, wherein the particle is an agglomerate, an extrudate, a spray-dried particle, an aqueous slurry, or a mixture thereof.

17. A liquid laundry detergent composition according to claim 1, wherein the active material is selected from chelants, cellulosic polymer, perfume microcapsules, enzymes, or mixtures thereof.

18. A liquid laundry detergent composition according to claim 1, comprising between about 5% and about 15%, by weight of the liquid laundry detergent composition, of water.

19. A liquid laundry detergent composition according to claim 1, wherein the gel is present in a form of droplets dispersed within the liquid laundry detergent composition.

20. A water-soluble unit dose article comprising a water-soluble film and a first internal compartment, wherein the first internal compartment comprises a first liquid laundry detergent composition, wherein the first liquid laundry detergent composition is a liquid laundry detergent composition according to claim 1.

21. A water-soluble unit dose article according to claim 20, wherein the water-soluble unit dose article comprises a second internal compartment, wherein the second internal compartment comprises a second composition.

* * * * *